US008567289B2

(12) United States Patent
Hu

(10) Patent No.: US 8,567,289 B2
(45) **Date of Patent: *Oct. 29, 2013**

(54) OPEN END WRENCH CAPABLE OF FAST DRIVING

(76) Inventor: Bobby Hu, Taichung (TW)

( * ) Notice: Subject to any disclaimer, the term of this patent is extended or adjusted under 35 U.S.C. 154(b) by 203 days.

This patent is subject to a terminal disclaimer.

(21) Appl. No.: 13/196,977

(22) Filed: Aug. 3, 2011

(65) Prior Publication Data

US 2011/0308360 A1 Dec. 22, 2011

Related U.S. Application Data

(63) Continuation-in-part of application No. 12/890,767, filed on Sep. 27, 1010, now Pat. No. 8,402,866.

(30) Foreign Application Priority Data

Apr. 30, 2010 (TW) ..... 99113946 A
Apr. 29, 2011 (TW) ..... 100115290 A

(51) Int. Cl.

| | |
|---|---|
| ***B25B 23/16*** | (2006.01) |
| ***B25B 13/00*** | (2006.01) |
| ***B25B 13/28*** | (2006.01) |
| ***B25G 1/00*** | (2006.01) |

(52) U.S. Cl.
USPC ..... 81/179; 81/177.85; 81/186; 81/92; 81/94

(58) Field of Classification Search
USPC ..... 81/60–63.2, 177.85
See application file for complete search history.

(56) References Cited

U.S. PATENT DOCUMENTS

| | | | | |
|---|---|---|---|---|
| 1,320,668 | A | 11/1919 | Askman | 81/179 |
| 3,695,125 | A | 10/1972 | Glass et al. | 81/179 |
| 4,706,528 | A | 11/1987 | Inoue | 81/179 |
| 7,024,971 | B2 | 4/2006 | Stanton | 81/179 |
| 7,827,887 | B2 | 11/2010 | Lee | 81/179 |
| 8,402,866 | B2 * | 3/2013 | Hu | 81/179 |
| 2009/0301271 | A1 | 12/2009 | Tuan-Mu et al. | 81/179 |
| 2010/0071516 | A1 * | 3/2010 | Wu | 81/176.1 |

* cited by examiner

*Primary Examiner* — Monica Carter
*Assistant Examiner* — Danny Hong
(74) *Attorney, Agent, or Firm* — Alan Kamrath; Kamrath IP Lawfirm, P.A.

(57) ABSTRACT

An open end wrench includes first and second jaws. The first jaw includes an arcuate sliding groove having two support walls and an arcuate sliding wall between the support walls. A slide is slideably received in the sliding groove and includes an arcuate sliding face slideable along the sliding wall. Two wings respectively extend from top and bottom faces of the slide. Top and bottom extension faces extend from a wrenching face of the slide and are located on inner faces of the wings. A spacing is formed between an outer face of each wing and one of the support walls to avoid friction, allowing smooth movement of the slide between an extended position and a retracted position.

25 Claims, 12 Drawing Sheets

OPEN END WRENCH CAPABLE OF FAST DRIVING

CROSS REFERENCE TO RELATED APPLICATION

This is a continuation-in-part application of U.S. patent application Ser. No. 12/890,767 filed Sep. 27, 2010.

BACKGROUND OF THE INVENTION

The present invention relates to an open end wrench capable of fast driving and, more particularly, to an open end wrench capable of fast driving a workpiece without the risk of undesired shifting from the workpiece.

U.S. Pat. No. 1,320,668 discloses a wrench including a stationary jaw and a movable jaw slideable along a guide. The movable jaw is forced against an abutment at an outer end of the guide by a spring bearing against the stationary jaw. An end of the spring is received in a bore in the stationary jaw. The other end of the spring is received in another bore in the movable jaw. An intermediate portion of the spring is exposed between the stationary jaw and the movable jaw. When the user is intended to tighten or loosen a nut, the wrench is turned in a driving direction during which operation the movable jaw remains in contact with the abutment. For reengagement of the wrench with the nut it is necessary only to turn the wrench in the opposite direction, during which operation the movable jaw slides backward against the pressure of the spring and on the edges of the nut. The movable jaw is forced forward again as soon as the bearing surfaces of the stationary and movable jaws are parallel with the sides of the nut. The nut can be tightened or loosened through repeated operations. However, the structural strength of the wrench is insufficient for high-torque operation, as the movable jaw merely encloses the guide and is not enclosed by other members. Furthermore, the guide is irregularly formed in a wrenching space of the wrench, leading to difficulties in processing. Further, the exposed portion of the spring, when compressed by the movable jaw, is liable to bend and, thus, in frictional contact with the end edges of the bores of the stationary and movable jaws, leading to non-smooth compression of the spring or even permanent deformation of the spring. Further, the exposed portion of the spring is apt to be contaminated by oil to which debris easily adheres.

U.S. Pat. No. 3,695,125 discloses an open end ratchet wrench including a head having a fixed jaw and an opposed pawl support portion. A pawl and a spring are mounted to an inner side of the pawl support portion. The pawl is biased by the spring and slideable between an extended torquing position and a retracted ratcheting position. Two side caps are fixed to two sides of the head to define a space receiving the pawl and the spring and to prevent disengagement of the pawl and the spring. The pawl includes a stop shoulder to prevent the pawl from moving out of the pawl support portion under the action of the spring. The pawl support portion includes an arcuate section and then extends perpendicularly to the fixed jaw. Such a structure is difficult to process. Furthermore, assembly of the open end ratchet wrench is troublesome. Further, the pawl is merely enclosed at both sides and has insufficient structural strength in the lateral direction. Further, a contact area of the workpiece (such as a nut) engaged with the movable pawl is smaller than a contact area of the workpiece engaged with the fixed jaw. When the nut is tightened to a position adjacent to an object to be fixed, wear or damage to the nut may occur if the nut has insufficient contact area or has a small volume.

U.S. Pat. No. 4,706,528 discloses an adjustable wrench including a fixed jaw and an adjustable jaw. In an embodiment, a sliding jaw portion is provided on the fixed jaw. The sliding jaw includes a rectilinearly extending slot through which a pin is extended, preventing disengagement of the sliding jaw. A plate spring is mounted to an inner face of the fixed jaw to bias the sliding jaw outward. A hole is formed in an end wall of the slot and receives a coil spring to bias the sliding jaw inward. Thus, the sliding jaw is movable inward or outward and can be retained in place under action of the plate spring and the coil spring. Such a wrench is particularly suitable for rotating pipes, but not suitable for tightening or loosening fasteners such as bolts, nuts, or the like. This is because the sliding jaw can only slide rectilinearly, and the shape of the slot will cause the sliding jaw to slide along the slot to a position pressing against the periphery of the pipe.

U.S. Pat. No. 7,024,971 discloses an open end ratchet wrench including first and second stationary jaws. The first stationary jaw supports a movable plate. A space is sandwiched between two face plates of the first stationary jaw to accommodate the movable plate. The movable plate includes two angled slots each receiving a pin extending through the space, avoiding disengagement of the movable plate. The wrench further includes a hole receiving a spring that has an end located outside of the hole for biasing the movable plate. Each angled slot of the movable plate includes a short section and a long section at an angle to the short section such that the movable plate can move in two stages each having a rectilinear travel. However, the stationary jaw is enclosed by the movable plate such that the contact area between the stationary jaw and the workpiece is significantly decreased. Instead, the supporting effect depends on the larger contact area between the workpiece and the movable plate with structural strength weaker than the fixed jaw. The holding force applied by the open end ratchet wrench is reduced.

U.S. Patent Publication No. US 2009/0301271 A1 discloses an open-ended wrench including a first jaw and a second jaw. The second jaw includes an auxiliary jaw retracting opening that receives an auxiliary jaw. A spring is mounted between an end of the auxiliary jaw and an end wall of the auxiliary jaw retracting opening. The auxiliary jaw includes a limiting slot. An auxiliary jaw limiting member extends from a surface of the second jaw through an opening to the auxiliary jaw retracting opening and is coupled with the limiting slot for confining the auxiliary jaw to move between a first position in which the auxiliary jaw is non-longitudinally biased and a second position in which the auxiliary jaw is longitudinally biased. The auxiliary jaw has an arcuate pushing surface and a driving surface. In use, the wrench can drive a nut in a driving direction to a position and then directly move in a reverse direction about the center of the nut. The auxiliary jaw is compressed by a side of the nut and retracts into the auxiliary retracting opening. Thus, the wrench can be directly rotated in the reverse direction through an angle to a next driving position for driving the nut in the driving direction without the need of disengaging from the nut and reengaging with the nut. However, it is difficult to form the auxiliary jaw retracting opening in the second jaw, which is particularly true for axial drilling. Furthermore, the pushing face and the driving surface of the auxiliary jaw must retract into the auxiliary retracting opening so that the wrench can move in the reverse direction to the next driving position. Thus, the widths of the pushing face and the driving surface must be smaller than the size of the auxiliary jaw retracting opening. However, if the nut is of a smaller thickness or if the nut is moved to a position adjacent to a surface of an object to be tightened such that the width of the side of the nut is smaller than the extent of the pushing face and the driving surface, the pushing face and the driving surface may be worn or damaged due to insufficient contact area with the side of the nut.

FIG. 1 shows a reciprocatable open end wrench 50 including a jaw portion 51 having first and second jaws and defining a wrenching space 52. The second jaw includes a concave arcuate surface having a slot. A swing member 53 is received in the slot. A surface of the swing member 53 faces the second jaw and has an arcuate hollow groove for receiving a spring 54. The concave arcuate surface has a curvature corresponds to that of an arcuate face 532 of the swing member 53. The swing member 53 has a clamping face 531 for contacting with a side of a workpiece 90. The clamping face 531 is planar so as to be in surface contact with the side of the workpiece 90 for driving the workpiece 90. An example of such a wrench is disclosed in U.S. Patent Publication No. US 2010/0071516 A1. However, the diameter D53 of the curvature of the arcuate face 532 is not concentric to the wrenching width S between two parallel sides of the workpiece 90. After the wrench 50 has driven the workpiece 90 to rotate in a driving direction, the rotating arc of the diameter D53 can not allow the wrench 50 to rotate in a reverse direction to the next driving position. Specifically, the wrench 50 has to be moved backwards through a certain travel so that the arcuate face 531 can slide along the side of the workpiece 90 to the next driving position. If the wrench 50 is directly rotated about the center of the workpiece 90 without the backward travel, the arcuate face 531 will be interfered by a side of the workpiece 90. The driving operation provided by the wrench is not smooth.

Thus, a need exists for an open end wrench capable of fast driving of a workpiece without the disadvantages of the above conventional open end wrenches.

BRIEF SUMMARY OF THE INVENTION

The present invention solves this need and other problems in the field of reliable structural strength of fast drivable open end wrenches by providing, in a first aspect, an open end wrench capable of fast driving a workpiece. The workpiece includes first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction. The open end wrench includes a body having a handle and a jaw portion formed on an end of the handle. The spaced first and second jaws are formed on an end of the jaw portion opposite to the handle. The jaw portion further includes an arcuate sliding groove facing the wrenching space. The sliding groove includes spaced, first and second support walls and an arcuate sliding wall extending between the first and second support walls. A guide is fixed in the sliding groove. A slide is slideably received in the sliding groove between an extended position and a retracted position. The slide includes a first side having an arcuate sliding face slideable along the sliding wall of the sliding groove. The slide further includes a second side opposite to the first side of the slide and located outside of the sliding groove. The second side of the slide includes a first wrenching face. The first wrenching face is adapted to correspond to the fourth force-receiving face in the first rotating direction of the workpiece when the slide is in the extended position. The slide further includes a top face and a bottom face. The slide further includes an arcuate guiding slot extending from the top face through the bottom face. The guide is received in the guiding slot to prevent the slide from disengaging from the sliding groove. The guiding slot includes a pressing end. An elastic device has two ends respectively abutting the guide and the pressing end of the guiding slot for biasing the slide to the extended position. The first wrenching face of the slide includes first and second wings respectively extending away from the top and bottom faces of the first wrenching face. Each of the first and second wings includes an inner face and an outer face. The first and second jaws and the first wrenching face and the inner faces of the first and second wings of the slide together define a curve of a circle having a center located on an axis of the workpiece, allowing the first and second jaws and the first wrenching face and the first and second wings of the slide to rotate about the workpiece and allowing the first wrenching face and the first and second wings to slide along a circumference of a circumscribed circle of the workpiece without interference. A spacing is formed between the outer face of each of the first and second wings and one of the first and second support walls. The spacings avoid operational interference to sliding movement of the slide in the sliding groove while the first and second jaws and the first wrenching face and the first and second wings of the slide rotate about the workpiece.

Preferably, the jaw portion includes a throat intermediate the first and second jaws. The throat and the first and second jaws together define a wrenching space adapted for receiving the workpiece. The first jaw includes a force-applying face facing the wrenching space and facing a front end of the second jaw. The force-applying face is adapted to correspond to the first force-receiving face in the first rotating direction of the workpiece.

Preferably, the guide has two ends fixed to the first and second support walls.

Preferably, the guiding slot includes an abutting end. The abutting end is in contact with the guide when the slide is in the extended position.

Preferably, the slide further includes a second wrenching face at an angle of 120° to the first wrenching face. The second wrenching face is adapted to correspond to the third force-receiving face in the first rotating direction of the workpiece.

Preferably, the slide further includes an evasive portion between the first and second wrenching faces. The evasive portion of the slide is adapted to allow entrance of the third force-receiving face in the second rotating direction of the workpiece.

Preferably, the sliding face of the slide has a first curvature. The sliding wall of the sliding groove has a second curvature equal to the first curvature. The sliding face of the slide is smoothly slideable along the sliding wall of the sliding groove. The sliding face is adapted to transmit reactive force from the workpiece to the sliding wall and to avoid concentration of stress on the slide, increasing torque bearing capacity of the slide when the workpiece is driven by the body to rotate.

Preferably, the guiding slot has a third curvature equal to the second curvature, allowing relative smooth, arcuate sliding between the guiding groove of the slide and the guide in the sliding groove without operational interference therebetween.

Preferably, the top face of the slide slideably abuts the first support wall of the sliding groove. The bottom face of the slide slideably abuts the second support wall of the sliding groove. The top and bottom faces are symmetrically supported by the first and second support walls.

Preferably, the first and second jaws and the jaw portion are integrally formed as a single and inseparable component of a same material.

Preferably, the throat includes a push face facing the wrenching space. The push face is at an angle of 120° to the force-applying face of the first jaw. The push face of the throat is adapted to correspond to the second force-receiving face in the first rotating direction of the workpiece.

Preferably, the second jaw includes first and second faces. The first face of the second jaw faces the wrenching space and the throat. The second face of the second jaw faces the wrenching space and a front end of the first jaw. The first face of the second jaw is at an angle of 120° to the second face of the second jaw. The first and second faces are adapted to correspond respectively to the fourth and third force-receiving faces in the first rotating direction of the workpiece. The first face of the second jaw is parallel to the force-applying face of the first jaw. A first evasive portion is formed between the force-applying face of the first jaw and the push face of the throat. The first evasive portion is adapted to allow entrance of the first force-receiving face in the second rotating direction of the workpiece. A second evasive portion is formed between the push face of the throat and the second face of the second jaw. The first evasive portion is adapted to allow entrance of the second force-receiving face in the second rotating direction of the workpiece. The jaw portion further includes a third evasive portion between first and second faces of the second jaw. The third evasive portion is adapted to allow entrance of the third force-receiving face in the second rotating direction of workpiece.

Preferably, the elastic device includes an elastic element received in the guiding slot of the slide. The first and second support walls of the sliding groove are parallel to each other and have a spacing therebetween. The top and bottom faces of the slide are parallel to each other and have a height in a height direction of the slide equal to the spacing between the first and second support walls. The guiding slot of the slide has a height in the height direction of the slide equal to the height of the slide. The guiding slot has a width in a width direction perpendicular to the height direction of the guiding slot. The width of the guiding slot is equal to a diameter of the guide. The height of the guiding slot is larger than 1.5 times the width of the guiding slot. The elastic element received in the guiding slot has a height in the height direction of the slide not larger than the height of the guiding slot. The height of the elastic element is larger than the width of the guiding slot and larger than 0.5 times the height of the guiding slot.

In a second aspect, an open end wrench is capable of fast driving a workpiece. The workpiece includes an outer periphery having first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction. The open end wrench includes a body having a handle and a jaw portion formed on an end of the handle. The spaced first and second jaws are formed on an end of the jaw portion opposite to the handle. The first and second jaws and the jaw portion are integrally formed as a single and inseparable component of a same material. The jaw portion further includes a throat intermediate the first and second jaws. The first jaw includes a front end and a rear end. The rear end of the first jaw is connected to the throat. The second jaw includes a front end and a rear end. The rear end of the second jaw is connected to the throat. The throat and the first and second jaws together define a wrenching space. The wrenching space is adapted to receive the workpiece. The first jaw includes a force-applying face facing the wrenching space. The jaw portion further includes an arcuate sliding groove facing the wrenching space. The sliding groove includes spaced, first and second support walls and an arcuate sliding wall extending between the first and second support walls. A guide is fixed in the sliding groove and includes two ends fixed in the first and second support walls. A slide is slideably received in the sliding groove. The slide includes a first side having an arcuate sliding face slideable along the sliding wall of the sliding groove. The slide is capable of driving the workpiece or sliding along the outer periphery of the workpiece. The slide is movable between an extended position and a retracted position. The slide further includes a second side opposite to the first side of the slide. The second side of the slide is located outside of the sliding groove and includes a first wrenching face located on a front end of the slide. The slide further includes a top face and a bottom face. The top face slideably abuts the first support wall. The bottom face slideably abuts the second support wall. The top and bottom faces are symmetrically supported by the first and second support walls. The slide further includes an arcuate guiding slot extending from the top face through the bottom face. The guide is received in the guiding slot to prevent the slide from disengaging from the sliding groove. The guiding slot includes an abutting end and a pressing end. The front end of the slide includes first and second wings respectively extending away from the top and bottom faces. Each of the first and second wings includes inner and outer faces. The inner faces of the first and second wings are adapted to drive the workpiece. An elastic device is mounted in the guiding slot and has two ends respectively abutting the guide and the pressing end of the guiding slot. The elastic device urges the abutting end of the guiding slot to contact with the guide, biasing the slide to the extended position.

The inner faces of the first and second wings are adapted to contact with the outer periphery of the workpiece received in the wrenching space to increase a contact area between the workpiece and the slide. The outer faces of the first and second wings are spaced from the body to avoid friction between the body and the first and second wings, allowing smooth sliding movement of the slide between the extended position and the retracted position.

Preferably, the first wrenching face includes a top extension face extending away from the top face and a bottom extension face extending away from the bottom face. The top and bottom extension faces are coplanar to the first wrenching face and located on the inner faces of the two wings.

Preferably, the first and second jaws and the first wrenching face and the top and bottom extension faces of the slide together define a curve of a circle having a center located on an axis of the workpiece. The first and second jaws and the first wrenching face and the top and bottom extension faces of the slide are rotatable along about the center of the workpiece. The first wrenching face and the top and bottom extension faces are slideable along a circumference of a circumscribed circle of the workpiece without interference.

Preferably, the sliding wall of the sliding groove is free of holes, grooves, and recesses and has a concave, arcuate face. The sliding face of the slide is free of holes, grooves, and recesses and has a convex, arcuate face. The guiding slot is free of holes, grooves, and recesses.

Preferably, the force-applying face faces the front end of the second jaw. The sliding groove is formed in the second jaw and the throat and faces the wrenching space. The force-applying face is adapted to correspond to the first force-receiving face in the first rotating direction of the workpiece. The first wrenching face and the two wings of the slide are adapted to correspond to the fourth force-receiving face in the first rotating direction of the workpiece when the slide is in the extended position.

Preferably, the sliding face of the slide has a first curvature. The sliding wall of the sliding groove has a second curvature equal to the first curvature. The sliding face of the slide is smoothly slideable along the sliding wall of the sliding groove. Thee sliding face is adapted to transmit reactive force from the workpiece to the sliding wall and to avoid concentration of stress on the slide, increasing torque bearing capacity of the slide when the workpiece is driven by the body to rotate. The guiding slot has a third curvature equal to the second curvature, allowing relative smooth, arcuate sliding between the guiding groove of the slide and the guide in the sliding groove without operational interference therebetween.

Preferably, with the slide further includes a second wrenching face at an angle of 120° to and located behind the first wrenching face. The second wrenching face is adapted to correspond to the third force-receiving face in the first rotating direction of the workpiece. The slide further includes an evasive portion between the first and second wrenching faces. The evasive portion of the slide is adapted to allow entrance of the third force-receiving face in the second rotating direction of the workpiece.

Preferably, the throat includes a push face facing the wrenching space. The push face is at an angle of 120° to the force-applying face of the first jaw. The push face of the throat is adapted to correspond to the second force-receiving face in the first rotating direction of the workpiece.

Preferably, the second jaw includes first and second faces. The first face of the second jaw faces the wrenching space and the rear end of the first jaw. The second face of the second jaw faces the wrenching space and the front end of the first jaw. The first face of the second jaw is at an angle of 120° to the second face of the second jaw. The first and second faces of the second jaw are adapted to correspond respectively to the fourth and third force-receiving faces in the first rotating direction of the workpiece. The first face of the second jaw is parallel to the force-applying face of the first jaw. A first evasive portion is formed between the force-applying face of the first jaw and the push face of the throat. The first evasive portion is adapted to allow entrance of the first force-receiving face in the second rotating direction of the workpiece. A second evasive portion is formed between the push face of the throat and the second face of the second jaw. The second evasive portion is adapted to allow entrance of the second force-receiving face in the second rotating direction of the workpiece. The jaw portion further includes a third evasive portion between first and second faces of the second jaw. The third evasive portion is adapted to allow entrance of the third force-receiving face in the second rotating direction of workpiece.

Preferably, the elastic device includes an elastic element received in the guiding slot. The first and second support walls of the sliding groove are parallel to each other and have a spacing therebetween. The top and bottom faces of the slide are parallel to each other and have a height in a height direction of the slide equal to the spacing between the first and second support walls. The guiding slot of the slide has a height in the height direction of the slide equal to the height of the slide. The guiding slot has a width in a width direction perpendicular to the height direction of the guiding slot. The width of the guiding slot is equal to a diameter of the guide. The height of the guiding slot is larger than 1.5 times the width of the guiding slot. The elastic element has a height in the height direction of the slide not larger than the height of the guiding slot. The height of the elastic element is larger than the width of the guiding slot and larger than 0.5 times the height of the guiding slot.

Preferably, the elastic element is one of a resilient plate, a compression spring, a torsion spring, and a dual compression spring. The dual compression spring has spaced upper and lower coil portions and a connecting portion between the upper and lower coil portions. The upper and lower coil portions are spaced in the height direction of slide.

Preferably, the elastic device includes a base and two compression springs. The base includes two protrusions spaced in a height direction of the slide or two receptacles spaced in the height direction of the slide. Each of the two compression springs has an end mounted to one of the two protrusions or one of the two receptacles. The two compression springs are spaced in the height direction of the slide.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
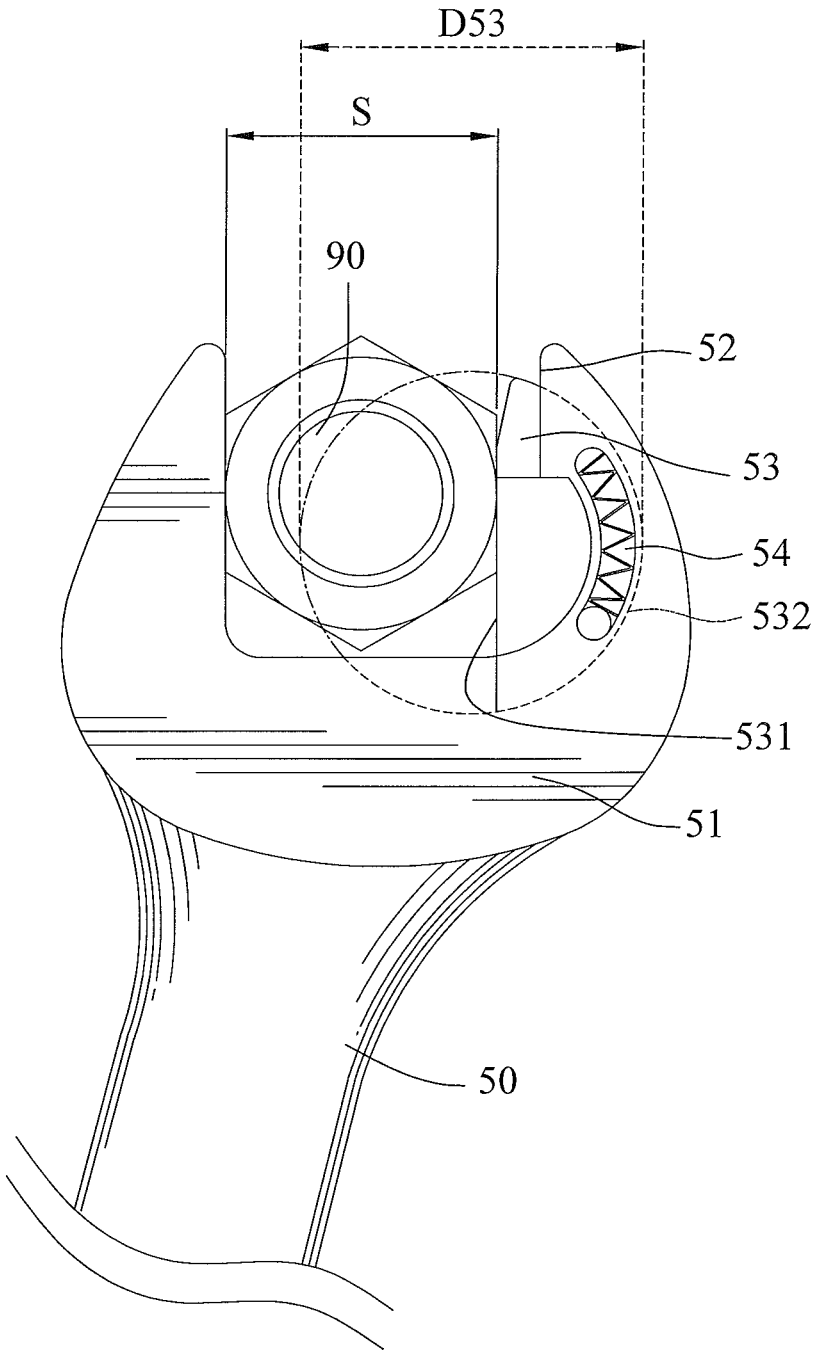
FIG.1 PRIOR ART
FIG. 1 shows a partial, top view of a conventional open end wrench.
Figure 2:
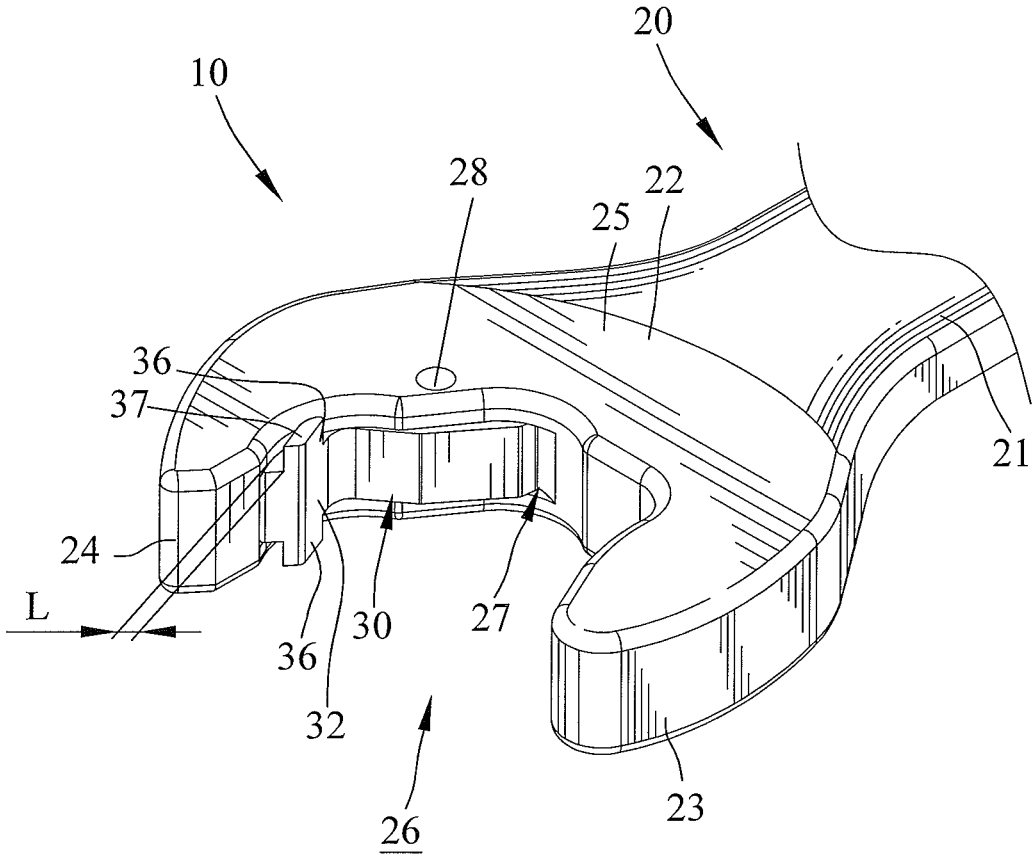
FIG. 2 shows a partial, perspective view of an open end wrench according to the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "sixth", "lower", "upper", "inner", "outer", "side", "end", "portion", "section", "spacing", "clockwise", "counterclockwise", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIGS. 2-12 show an open end wrench 10 according to the present invention. In the form shown, open end wrench 10 includes a body 20, a slide 30, and an elastic device 40. Body 20 includes a handle 21 and a jaw portion 22 formed on an end of handle 21. Jaw portion 22 can hold a workpiece 90, such as a hexagonal head of a bolt, a nut, or the like. Workpiece 90 includes an outer periphery having first, second, third, fourth, fifth, and sixth sides 91, 92, 93, 94, 95, and 96 respectively having first, second, third, fourth, fifth, and sixth force-receiving faces in a first rotating direction 91A, 92A, 93A, 94A, 95A, and 96A. First, second, third, fourth, fifth, and sixth sides 91, 92, 93, 94, 95, and 96 of workpiece 90 respectively have first, second, third, fourth, fifth, and sixth force-receiving faces in a second rotating direction 91B, 92B, 93B, 94B, 95B, and 96B. A user can grip the handle 21 and rotate body 20 as well as jaw portion 22 about axis C of workpiece 90 to tighten or loosen workpiece 90.

Spaced first and second jaws 23 and 24 are formed on an end of jaw portion 22 opposite to handle 21. First and second jaws 23 and 24 can withstand reactive force from workpiece 90. First and second jaws 23 and 24 face each other. Furthermore, first and second jaws 23 and 24 and jaw portion 22 are integrally formed as a single and inseparable component of the same material to provide jaw portion 22 with excellent structural strength and to increase the torque bearing capacity of jaw portion 22.

Jaw portion 22 further includes a throat 25 intermediate first and second jaws 23 and 24. Throat 25 and first and second jaws 23 and 24 together define a wrenching space 26. Workpiece 90 can enter wrenching space 26 by moving jaw portion 22 in a direction perpendicular to one of the six sides of workpiece 90 or by moving jaw portion 22 along axis C of workpiece 90.

First jaw 23 includes a front end and a rear end connected to throat 25. Second jaw 24 includes a front end and a rear end connected to throat 25.

First jaw 23 includes a force-applying face 231 facing wrenching space 26 and facing the front end of second jaw 24. Force-applying face 231 corresponds to first force-receiving face in the first rotating direction 91A of workpiece 90. Second jaw 24 includes first and second faces 241 and 242. First face 241 faces wrenching space 26 and the rear end of first jaw 23. Second face 242 faces wrenching space 26 and the front end of first jaw 23. First face 241 is at an angle of 120° to second face 242 such that first and second faces 241 and 242 correspond respectively to fourth and third force-receiving faces in the first rotating direction 94A and 93A. First face 241 of second jaw 24 is substantially parallel to force-applying face 231 of first jaw 23.

Throat 25 includes a push face 251 facing wrenching space 26. Push face 251 is at an angle of 120° to force-applying face 231 of first jaw 23 such that push face 251 corresponds to second force-receiving face in the first rotating direction 92A. Second face 242 is intermediate first face 241 and push face 251.

Jaw portion 22 further includes a first evasive portion 221 between force-applying face 231 of first jaw 23 and push face 251 of throat 25. First evasive portion 221 can receive first force-receiving face in the second rotating direction 91B of workpiece 90. Jaw portion 22 further includes a second evasive portion 222 between push face 251 of throat 25 and second face 242 of second jaw 24. Second evasive portion 222 can receive second force-receiving face in the second rotating direction 92B of workpiece 90. Furthermore, jaw portion 22 includes a third evasive portion 223 between first and second faces 241 and 242 of the second jaw 24. Third evasive portion 223 can receive third force-receiving face in the second rotating direction 93B of workpiece 90.

An arcuate sliding groove 27 is formed in second jaw 24 and throat 25 and faces wrenching space 26. Sliding groove 27 includes spaced, first and second support walls 272 and 273 and a concave, arcuate sliding wall 271 extending between first and second support walls 272 and 273. Sliding wall 271 is free of holes, grooves, recesses, etc, providing a complete concave arcuate surface and enhancing the structural strength of second jaw 24. Thus, jaw portion 22 can withstand high-torque operation. Furthermore, a center of a concave, arcuate face of the sliding wall 271 is located in wrenching space 26 such that sliding wall 271 can be easily and rapidly processed with a single cutter at low costs while assuring structural strength of jaw portion 22. First and second support walls 272 and 273 are parallel to each other and have a spacing T27 therebetween.

A circular through-hole 274 is extended through first and second support walls 272 and 273 and in communication with sliding groove 27. Through-hole 274 is located adjacent to throat 25 and receives a cylindrical guide 28 in the form of a pin. Two ends of guide 28 are received in two ends of through-hole 274 in first and second support walls 272 and 273 to retain guide 28 in sliding groove 27. Guide 28 has a diameter D28.

Slide 30 is slideably received in sliding groove 27 between an extended position and a retracted position and can drive workpiece 90 to rotate in a driving direction or slide along a perimeter of workpiece 90 in a reverse direction opposite to the driving direction without driving workpiece 90. Slide 30 is substantially arcuate in cross section and includes a side having a convex, arcuate sliding face 31 slideably abutting sliding wall 271 of sliding groove 27, allowing relative arcuate sliding movement between slide 30 and jaw portion 22. Sliding face 31 is free of holes, grooves, recesses, etc, providing a complete convex, arcuate surface and enhancing the structural strength of slide 30. Thus, slide 30 can withstand high-torque operation.

Sliding face 31 of slide 30 has a curvature the same as that of sliding wall 271 of sliding groove 27 to allow smooth sliding of sliding face 31 on sliding wall 271. Furthermore, when slide 30 is subjected to reactive force from workpiece 90, due to the same curvature of sliding wall 271 and sliding face 31, the reactive force from the workpiece 90 can be transmitted to sliding wall 271 through a large area of sliding face 31 while avoiding wobbling of sliding 30 during rotation of workpiece 90. Thus, the torque bearing capacity of slide 30 is increased when workpiece 90 is driven by body 20.

The other side of slide 30 opposite to sliding face 31 is located outside of sliding groove 27 and includes first and second wrenching faces 32 and 33. First and second wrenching faces 32 and 33 are adapted to drive workpiece 90 to rotate. First wrenching face 32 is at an angle of 120° to second wrench face 33. First wrenching face 32 is located on a front end of slide 30, and second wrenching face 33 is located on a rear end of slide 30. When slide 30 is in the extended position, first and second wrenching faces 32 and 33 correspond respectively to fourth and third force-receiving faces in the first rotating direction 94A and 93A of workpiece 90. An evasive portion 34 is formed between first and second wrenching faces 32 and 33 and can receive third force-receiving face in the second rotating direction 93B of workpiece 90.

Slide 30 further includes a top face 301 and a bottom face 302 respectively at upper and lower sides thereof. First and second wrenching faces 32 and 33 extend between top and bottom faces 301 and 302. Top and bottom faces 301 and 302 are parallel to each other and slideably abut with first and second support walls 272 and 273 of sliding groove 27, respectively. Slide 30 has a height H30 between top and bottom faces 301 and 302 in a height direction. Ignoring the tolerance, height H30 of slide 30 is the same as spacing T27 of sliding groove 27. This allows top and bottom faces 301 and 302 of slide 30 to be symmetrically supported by first and second support walls 272 and 273 of sliding groove 27, avoiding wobbling of slide 30 while sliding in sliding groove 27 along an arcuate path and increasing operational stability of open end wrench 10.

Slide 30 further includes a guiding slot 35 extending from top face 301 through bottom face 302. Guiding slot 35 is arcuate in cross section and has a curvature the same as the curvature of sliding wall 271 of sliding groove 27. Since guiding slot 35 extends from top face 301 through bottom face 302, a height H35 of guiding slot 35 in the height direction of slide 30 is the same as height H30 of slide 30. Furthermore, guiding slot 35 has a width W35 (between inner and outer arcuate surfaces thereof) in a width direction perpendicular to the height direction of slide 30. Namely, width W35 is equal to a difference between a radius of the outer arcuate surface and a radius of the inner arcuate surface of guiding slot 35. Ignoring the tolerance, width W35 of guiding slot 35 is the same as diameter D28 of guide 28. Height H35 of guiding slot 35 is larger than 1.5 times width W35 of guiding slot 35 (i.e., width W35 of guiding slot 35 is smaller than 0.66 times height H35 of guiding slot 35). In this embodiment, height H35 of guiding slot 35 is larger than two times width W35 of guiding slot 35 (i.e., width W35 of guiding slot 35 is smaller than 0.5 times height H35 of guiding slot 35).

Guiding slot 35 receives guide 28 to prevent slide 30 from disengaging from sliding groove 27. Since the curvature of sliding face 31 of slide 30 is the same as those of guiding slot 35 and sliding wall 271 of sliding groove 27, smooth sliding movement between guiding slot 35 of slide 30 and guide 28 in sliding groove 27 can be obtained while sliding face 31 of slide 30 is moving along sliding wall 271 of sliding groove 27 along the arcuate path. Undesired interference between slide 30, guide 28, and sliding wall 271 is avoided.

Guiding slot 35 further includes an abutting end 351 and a pressing end 352. When slide 30 is in the extended position, abutting end 351 is in contact with guide 28, and pressing end 352 is in contact with elastic device 40. Since all of the surfaces of guiding slot 35 are free of holes, grooves, recesses, etc, stress concentration is avoided, and the structural strength of slide 30 is assured. Thus, slide 30 can withstand high-torque operation. Furthermore, since sliding face 31 and all of the surfaces of guiding slot 35 of slide 30 are free of holes, grooves, recesses, etc, the manufacturing costs of slide 30 can be reduced while providing open end wrench 10 with high-torque capacity and allowing open end wrench 10 to be produced at low costs for wider industrial application.

Elastic device 40 has two ends respectively abutting guide 28 and pressing end 352 of guiding slot 35 for returning slide 30 to the extended position. Elastic device 40 includes an elastic element. After mounting, the elastic element is completely received in guiding slot 35. The elastic element has a height H40 in the height direction of slide 30. Height H40 of the elastic element is not larger than height H35 of guiding slot 35 and larger than width W35 of guiding slot 35. Furthermore, height H40 of the elastic element is larger than 0.5 times height H35 of guiding slot 35. By providing such an elastic element, the elastic element will not move away from its initial position in guiding slot 35, reliably returning slide 30 to the extended position under the bias of the elastic element.

Figure 3:
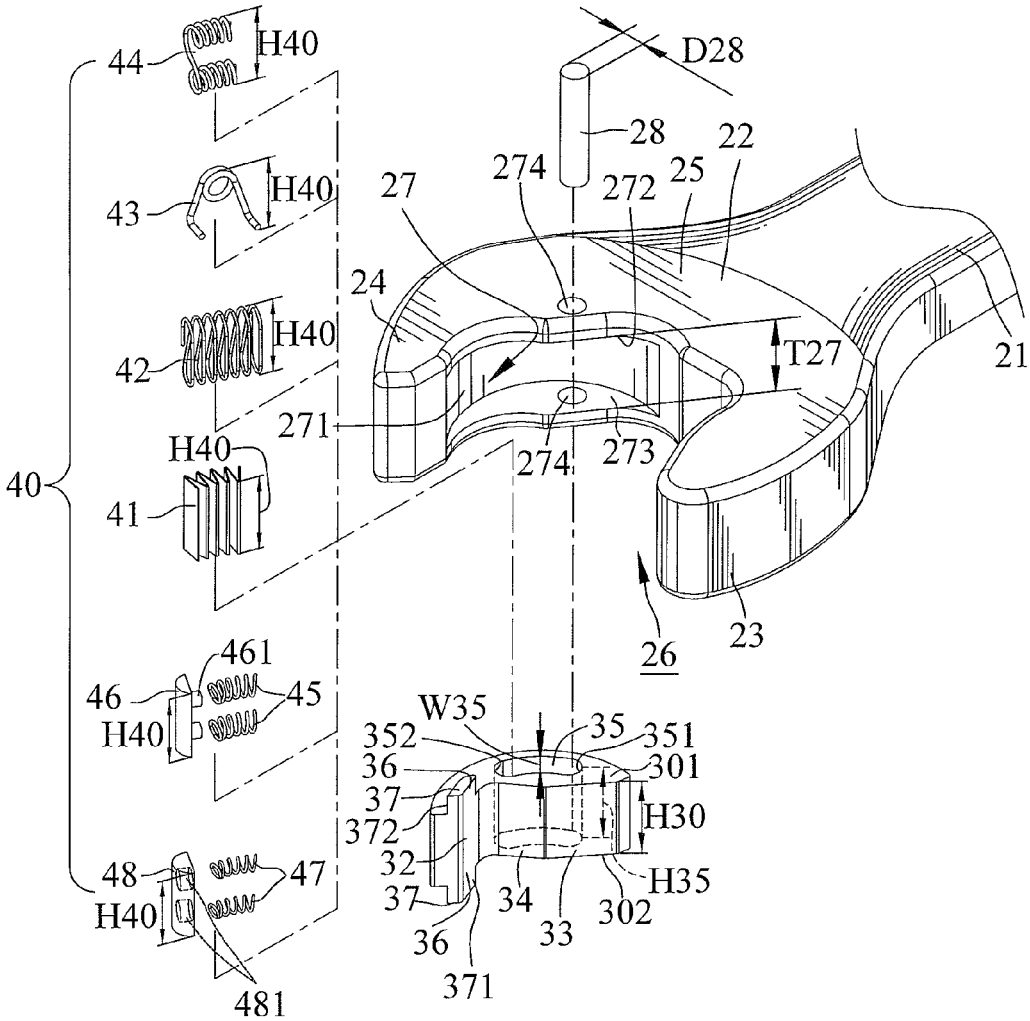
FIG. 3 shows a partial, exploded, perspective view of the open end wrench according to the present invention.
Figure 4:
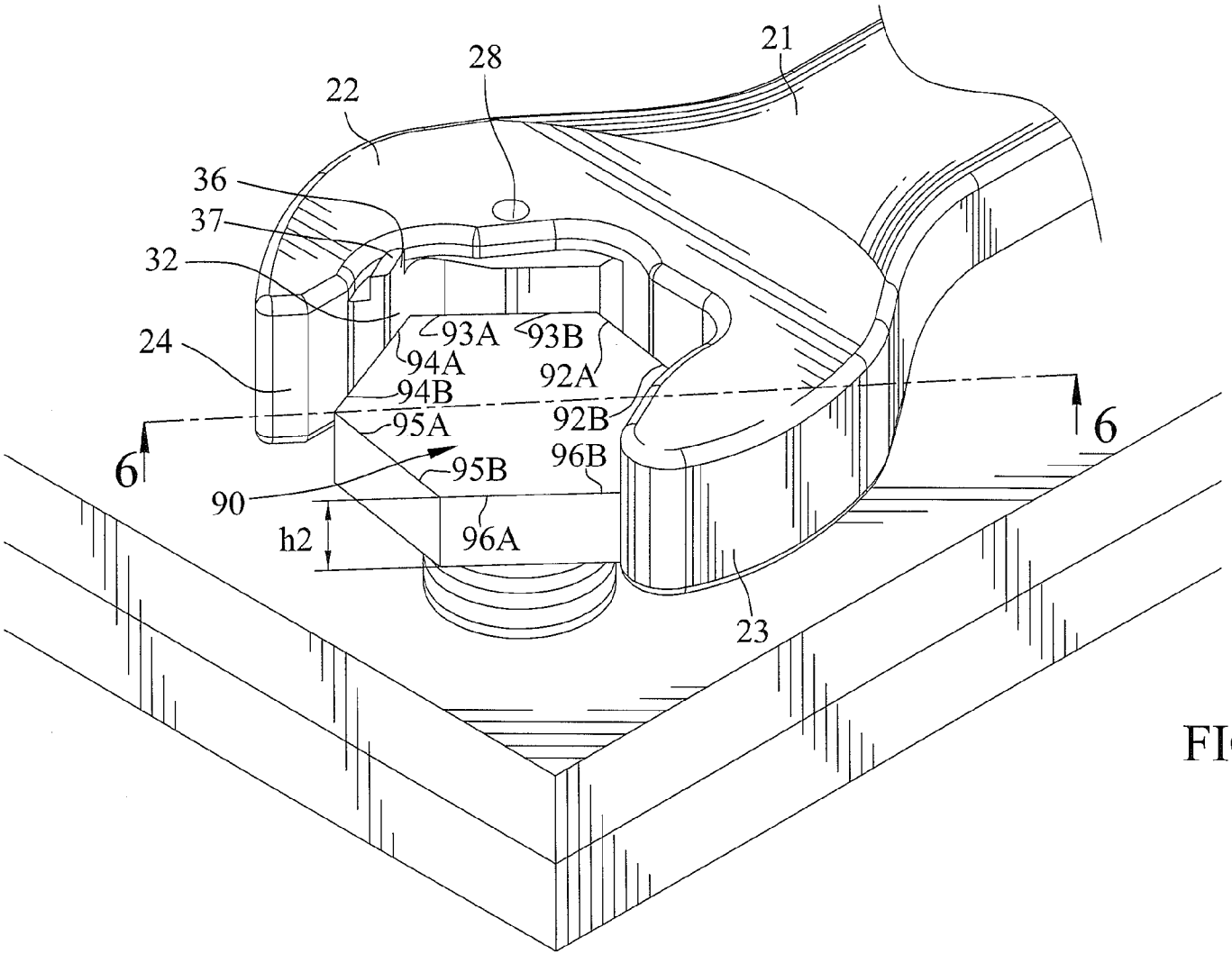
FIG. 4 shows a perspective view illustrating use of the open end wrench of FIG. 2 on a workpiece.
Figure 5:
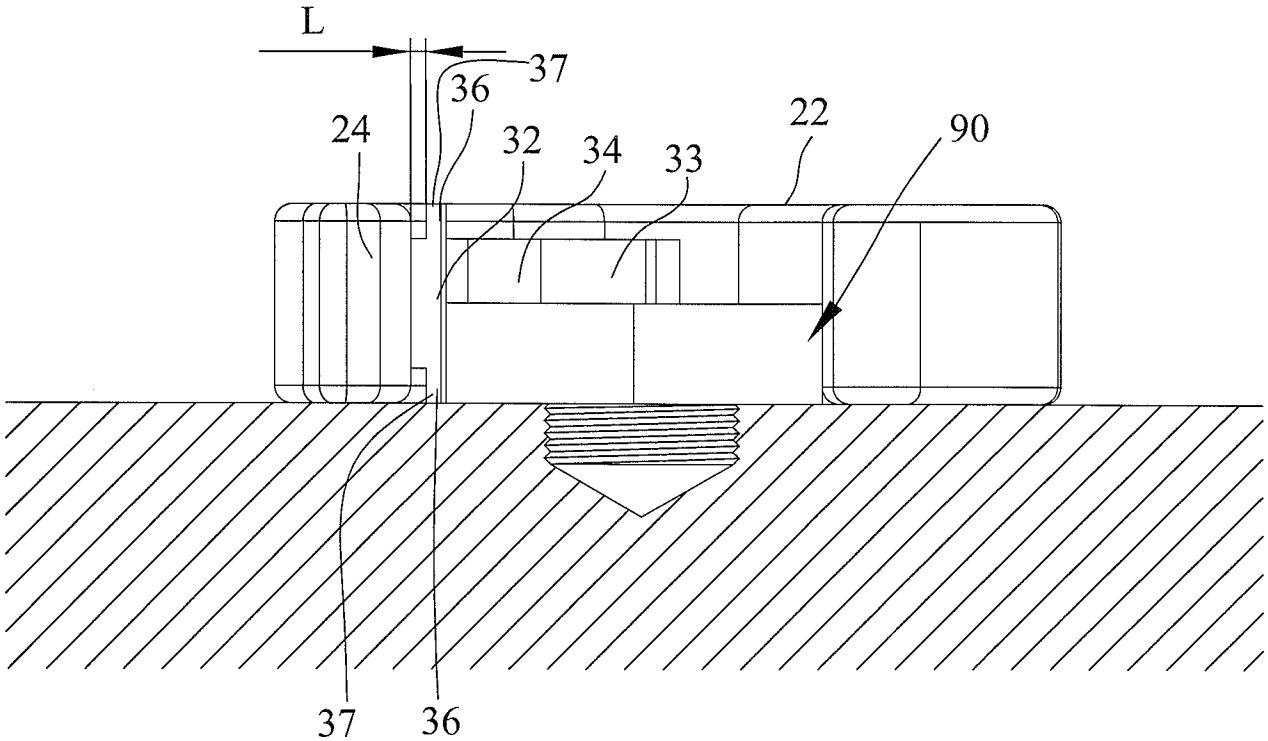
FIG. 5 shows a cross sectional view of the open end wrench and the workpiece of FIG. 4.

With reference to FIG. 3, the elastic element can be of different types and shapes. For example, the elastic element can be a resilient plate 41, a compression spring 42, a torsion spring 43, or a dual compression spring 44 having spaced upper and lower coil portions and a connecting portion between the upper and lower coil portions. The upper and lower coil portions are spaced in the height direction of slide 30. In another example, elastic device 40 includes a base 46 having two protrusions 461 spaced in the height direction of slide 30 and two compression springs 45 each having an end mounted to one of protrusions 461. Thus, springs 45 are spaced from each other in the height direction of slide 30 to prevent mutual interference during operation. In a further example, elastic device 40 includes a base 48 having two receptacles 481 spaced in the height direction of slide 30 and two compression springs 47 each having an end received in one of receptacles 481. Thus, springs 47 are spaced from each other in the height direction of slide 30 to prevent mutual interference during operation.

Figure 7:
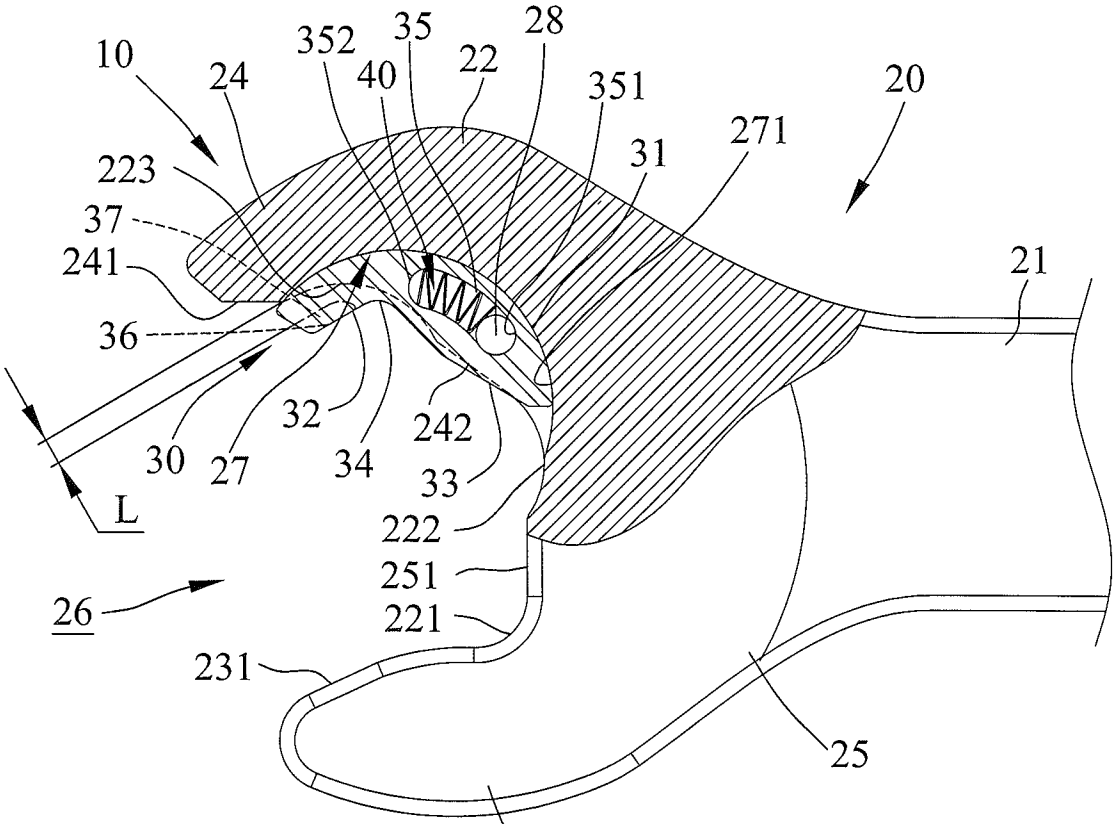
FIG. 7 shows a partial, top view of the open end wrench of FIG. 2, with a portion of the open end wrench cross sectioned.
Figure 8:
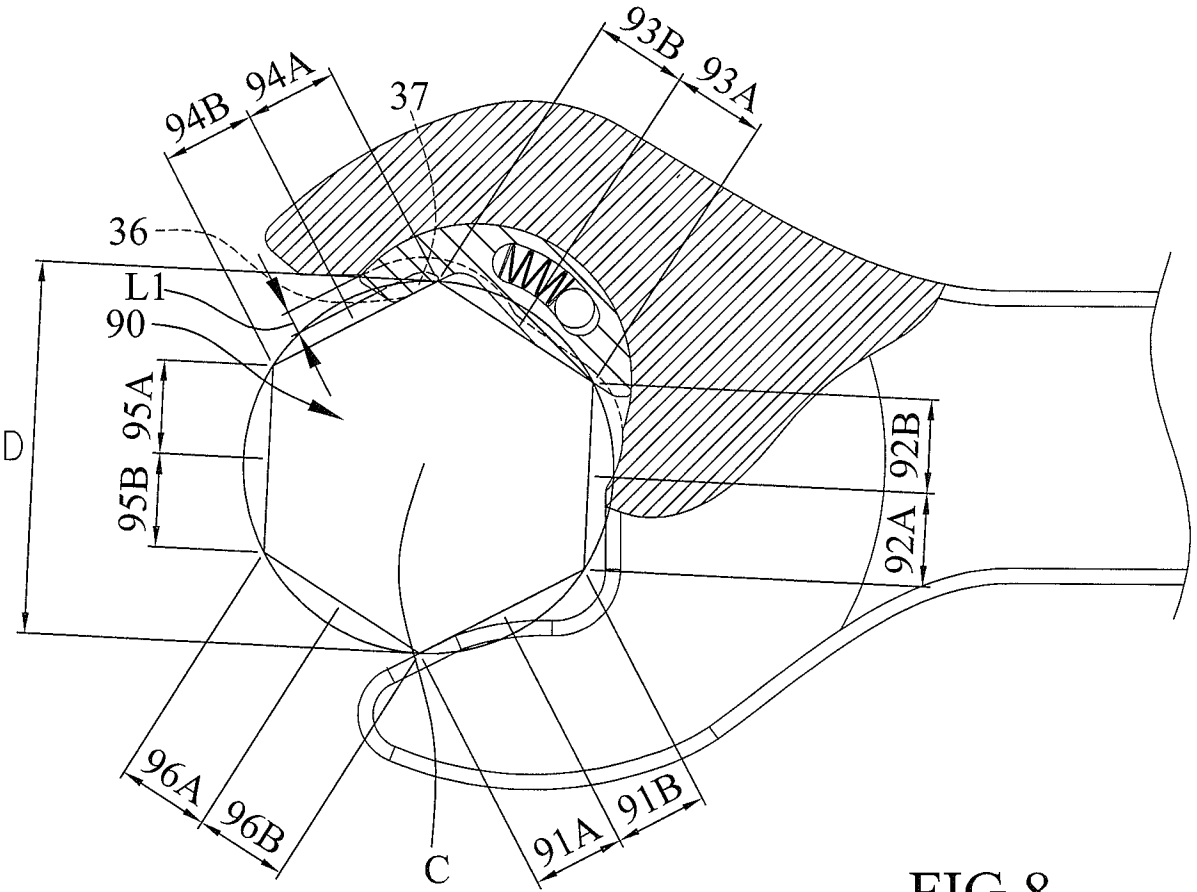
FIG. 8 shows a view similar to FIG. 7, illustrating use of the open end wrench of FIG. 7 on a workpiece.

With reference to FIG. 3, first wrenching face 32 includes a top extension face 36 extending away from top face 301 and a bottom extension face 36 extending away from bottom face 302. Top and bottom extension faces 36 are coplanar to first wrenching face 32. The front end of slide 30 includes two wings 37 respectively extending away from top and bottom faces 301 and 302. Each wing 37 includes an inner face 371 and an outer face 372. Top extension face 36 is located on inner face 371 of one of wings 37, and bottom extension face 36 is located on inner face 371 of the other wing 37. With reference to FIGS. 7 and 8, when slide 30 is in the extended position, first wrenching face 32 corresponds to fourth force-receiving face in the first rotating direction 94A of workpiece 90. First and second jaws 23 and 24, first wrenching face 32, and top and bottom extension faces 36 together define a curve of a circle having a center located on axis C of workpiece 90. Thus, first wrenching face 32 and top and bottom faces 36 of slide 30 can slide along a circumference of a circumscribed circle of workpiece 90 having a diameter D without interference. Wings 37 and top and bottom faces 36 extend in the height direction of slide 30 to increase the contact area between slide 30 and fourth force-receiving face in the first rotating direction 94A of workpiece 90.

In the form shown, wing 37 on top face 301 of slide 30 is spaced from first support wall 272 by a spacing L. Wing 37 on bottom face 302 of slide 30 is spaced from second support wall 273 by a spacing L. Spacings L avoid operational interference to sliding movement of slide 30 in sliding groove 27 while first and second jaws 23 and 24 and first wrenching face 32 and first and second wings 36 of slide 30 rotate about workpiece 90. Specifically, outer face 372 of each wing 37 does not contact with body 20, avoiding friction between wings 37 and body 20, Thus, sliding movement 30 is smooth without the risk of getting stuck. More specifically, when open end wrench 10 drives workpiece 90 in a direction towards first jaw 23 (the clockwise direction in FIG. 8), outer faces 372 of wings 37 are spaced from first and second support walls 272 and 273, allowing smooth movement of slide 30 between the extended position and the retracted position without the risk of getting stuck.

Figure 6:
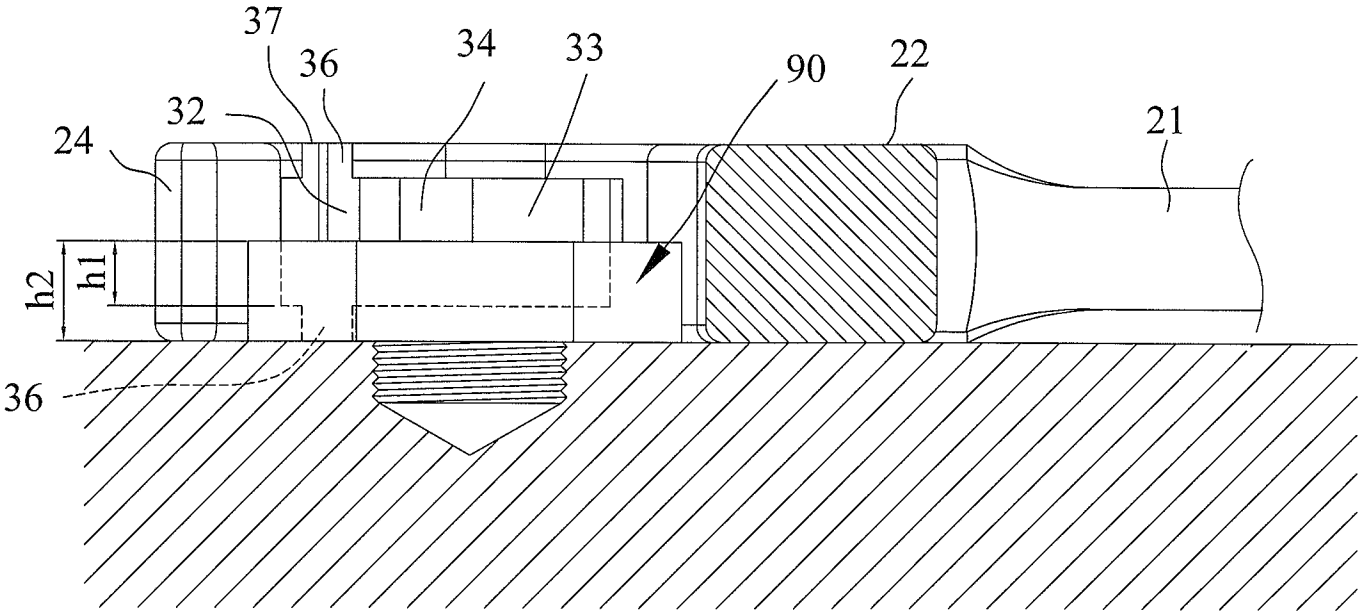
FIG. 6 shows a cross sectional view of the open end wrench and the workpiece of FIG. 4 according to section line 6-6 of FIG. 4.

Furthermore, after workpiece 90 (such as the hexagonal head of a bolt) is screwed to a flat surface (FIG. 4), open end wrench 10 can be in contact with an overall height h2 of workpiece 90 by first wrenching face 32 and top and bottom extension faces 36, providing high-torque operation by increasing the contact area between workpiece 90 and slide 32 at first wrenching face 32 and top and bottom extension faces 36 through provision of wings 37 while avoiding slide 32 from getting stuck, as shown in FIG. 6. First wrenching face 32 of slide 30 contacts a portion h1 of height h2 of workpiece 90.

With reference to FIG. 8, when a user intends to rotate workpiece 90 in the driving direction towards first jaw 23 (the clockwise direction in FIG. 8), workpiece 90 is firstly entered wrenching space 26 to a driving position with force-applying face 231 of first jaw 23 of jaw portion 22 abutting first force-receiving face in the first rotating direction 91A of workpiece 90 and with first wrenching face 32 and top and bottom extension faces 36 of slide 30 abutting fourth force-receiving face in the first rotating direction 94A of workpiece 90.

Since fourth force-receiving face in the first rotating direction 94A of workpiece 90 is parallel to first force-receiving face in the first rotating direction 91A, to make first wrenching face 32 and top and bottom extension faces 36 of slide 30 be in surface contact with fourth force-receiving face in the first rotating direction 94A, elastic device 40 in slide 30 is compressed and deformed to move slide 30 along the arcuate path such that first wrenching face 32 and top and bottom extension faces 36 of slide 30 can automatically abut fourth force-receiving face in the first rotating direction 94A while first wrenching face 32 and top and bottom extension faces 36 of slide 30 are substantially parallel to force-applying face 231 of first jaw 23.

In this case, the user can drive handle 21 in the clockwise direction to rotate jaw portion 22 about axis C of workpiece 90. The force applied by the user is transmitted through force-applying face 231 of first jaw 23 to first force-receiving face in the first rotating direction 91A of workpiece 90. At the same time, the force applied by the user is transmitted through first wrenching face 32 and top and bottom extension faces 36 of slide 30 to fourth force-receiving face in the first rotating direction 94A of workpiece 90. Thus, workpiece 90 rotates together with jaw portion 22.

Since first jaw 23 and jaw portion 22 are integrally formed as a single and inseparable component of the same material, force-applying face 231 of first jaw 23 can effectively withstand the reactive force from first force-receiving face in the first rotating direction 91A of workpiece 90. Furthermore, since second jaw 24 and jaw portion 22 are integrally formed as a single and inseparable component of the same material and since sliding face 31 of slide 30 and sliding wall 271 of sliding groove 27 are free of holes, grooves, recesses, etc and have the same curvature and are in surface contact with each other, sliding face 31 of slide 30 can contact with sliding wall 271 by a large area, avoiding wobbling of slide 30 in sliding groove 27 while driving workpiece 90. Thus, open end wrench 10 according to the present invention can withstand high-torque operation.

In this embodiment, second wrenching face 33 of slide 30 abuts third force-receiving face in the first rotating direction 93A of workpiece 90. Since second jaw 24 and jaw portion 22 are integrally formed as a single and inseparable component of the same material and since sliding face 31 of slide 30 and sliding wall 271 of sliding groove 27 are free of holes, grooves, recesses, etc and have the same curvature and are in surface contact with each other, sliding face 31 of slide 30 can contact with sliding wall 271 by a large area, avoiding wobbling of slide 30 in sliding groove 27 while driving workpiece 90. Thus, open end wrench 10 according to the present invention can withstand high-torque operation.

Figure 9:
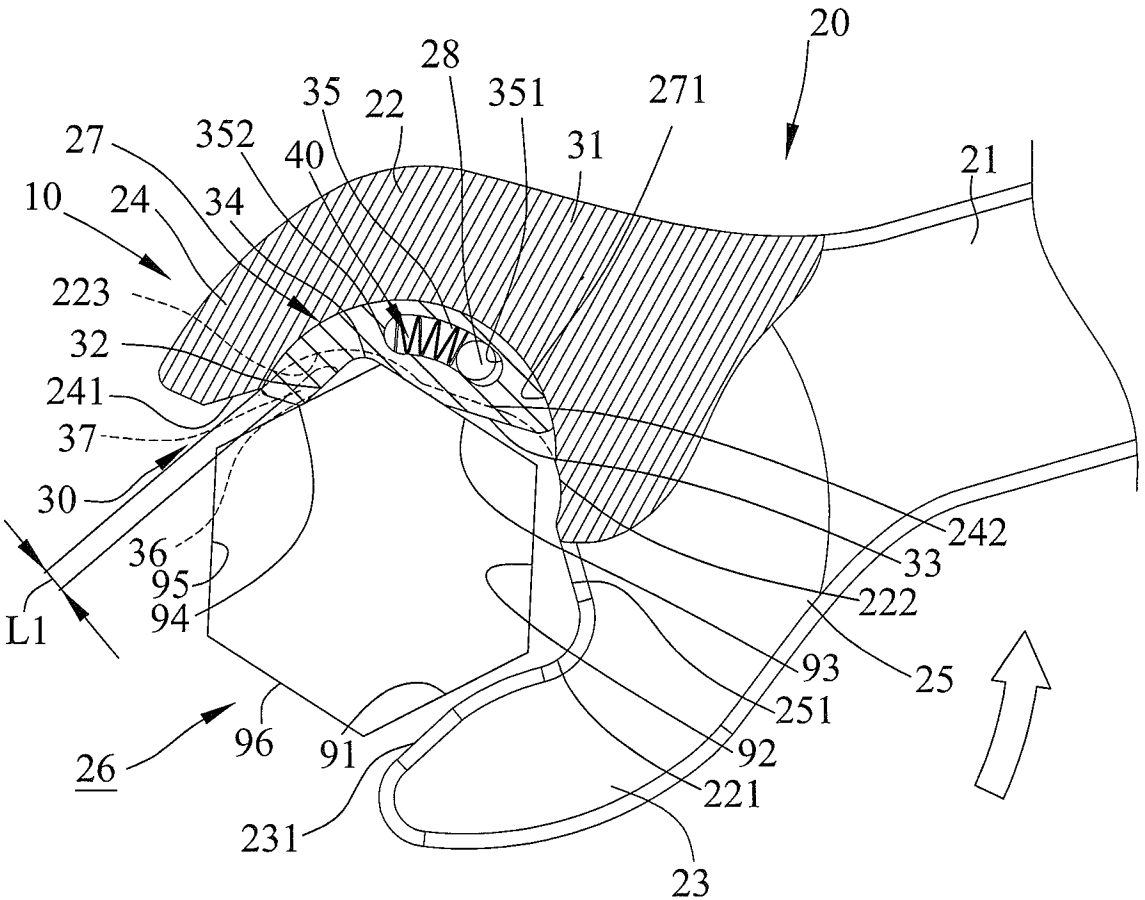
FIG. 9 shows a view similar to FIG. 8, illustrating rotation of the open end wrench of FIG. 8 in a non-driving direction reverse to a driving direction without driving the workpiece.
Figure 10:
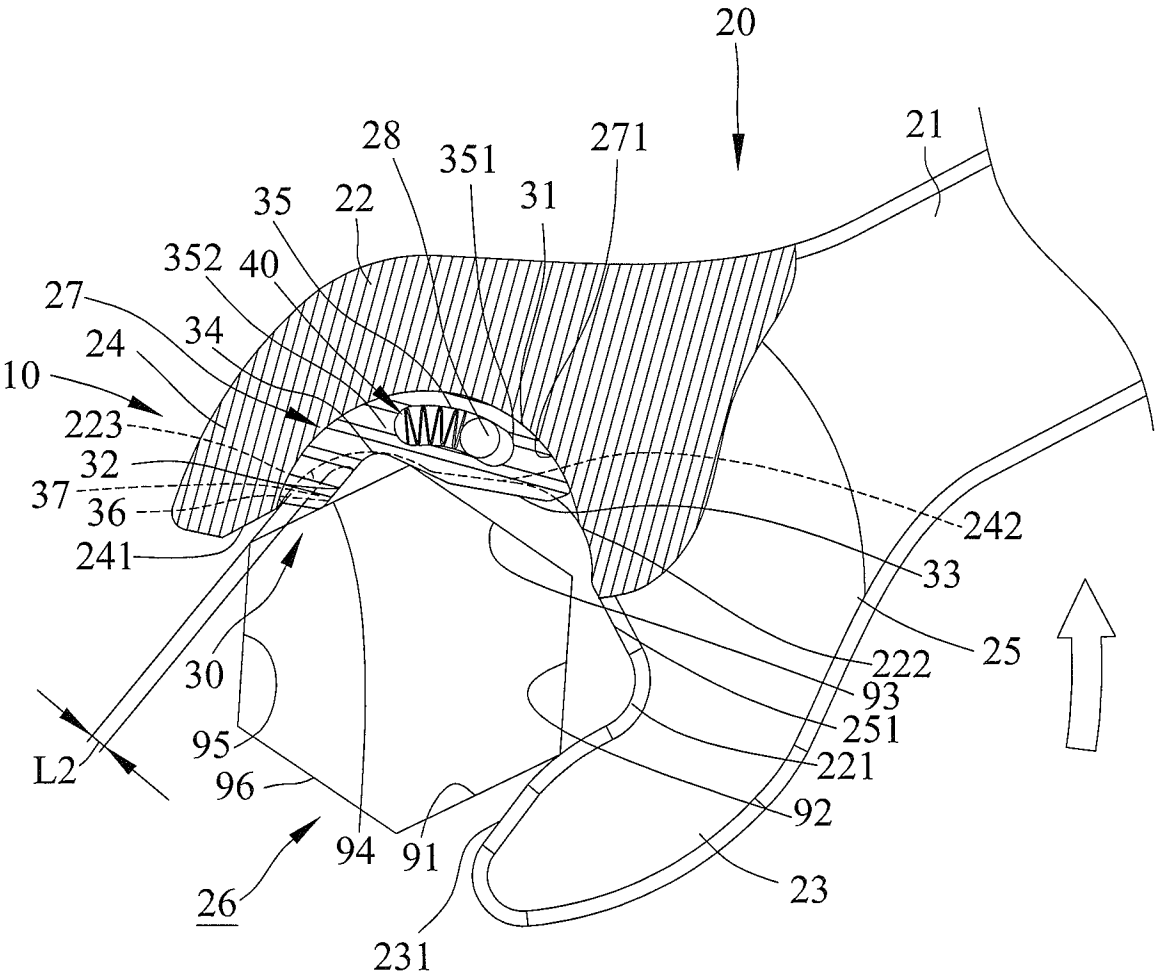
FIG. 10 shows a view similar to FIG. 9, illustrating further rotation of the open end wrench of FIG. 9 in the non-driving direction.
Figure 11:
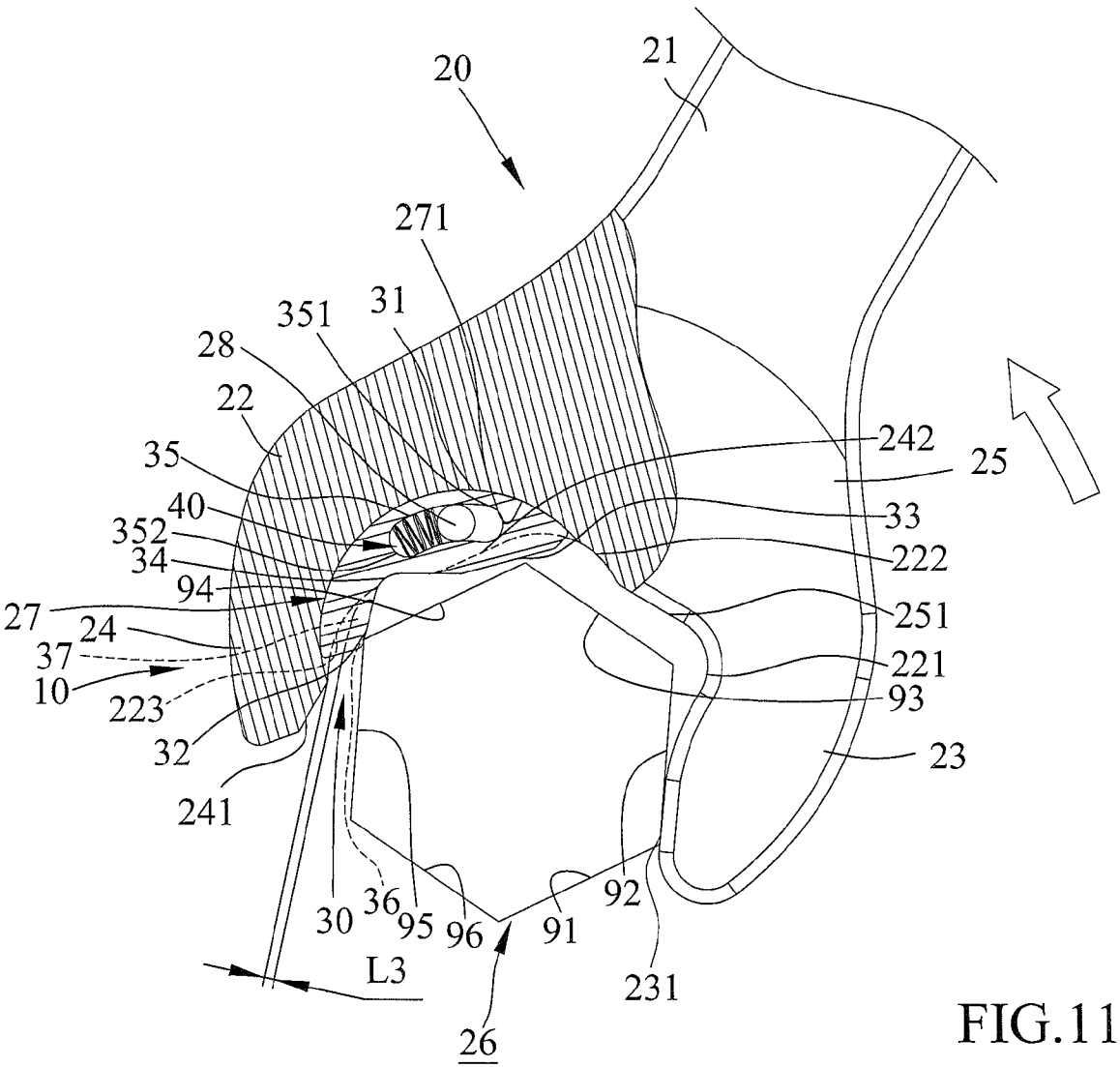
FIG. 11 shows a view similar to FIG. 10, illustrating further rotation of the open end wrench of FIG. 10 in the non-driving direction.

FIGS. 9-11 show rotation of open end wrench 10 according to the present invention in the reverse, non-driving direction towards second jaw 24 without driving workpiece 90. Namely, open end wrench 10 is moved in the reverse direction back to a position ready for driving workpiece 90 without the need of disengaging workpiece 90 from wrenching space 26 of jaw portion 22 and subsequent reengaging workpiece 90 in wrenching space 26, allowing fast driving of workpiece 90.

When the user moves handle 21 in the counterclockwise direction, jaw portion 22 and handle 21 rotate freely relative to workpiece 90 such that first and second evasive portions 221 and 222 of jaw portion 22 and evasive portion 34 of slide 30 respectively approach first, second, and third force-receiving faces in the second rotating direction 91B, 92B, and 93B of workpiece 90. Namely, first, second, and third force-receiving faces in the second rotating direction 91B, 92B, and 93B of workpiece 90 enter first and second evasive portions 221 and 222 and evasive portion 34.

Further rotation of jaw portion 22 in the counterclockwise direction causes evasive portion 34 of slide 30 to come into contact with third force-receiving face in the second rotating direction 93B of workpiece 90. In this case, elastic device 40 is compressed and moves slide 30 in sliding groove 27 along the arcuate path. Since outer faces 372 of wings 37 are spaced from body 20, friction does not exist between wings 20 and body 10 while open end wrench 10 drives workpiece 90 to rotate. Thus, movement of slide 30 between the extended position and the retracted position is smooth without the risk of getting stuck.

When slide 30 is pressed and moved along the arcuate path relative to jaw portion 22, jaw portion 22 can continue its rotation in the counterclockwise direction. Next, force-applying face 231 of first jaw 23 moves across first force-receiving face in the second rotating direction 91B of workpiece 90 and approaches second force-receiving face in the first rotating direction 92A of workpiece 90. At the same time, first wrenching face 32 of slide 30 moves across fourth force-receiving face in the second rotating direction 94B of workpiece 90 and approaches fifth force-receiving face in the first rotating direction 95A of workpiece 90. In this embodiment, second wrenching face 33 of slide 30 also moves across third force-receiving face in the second rotating direction 93B of workpiece 90 and approaches fourth force-receiving face in the first rotating direction 94A of workpiece 90.

Figure 12:
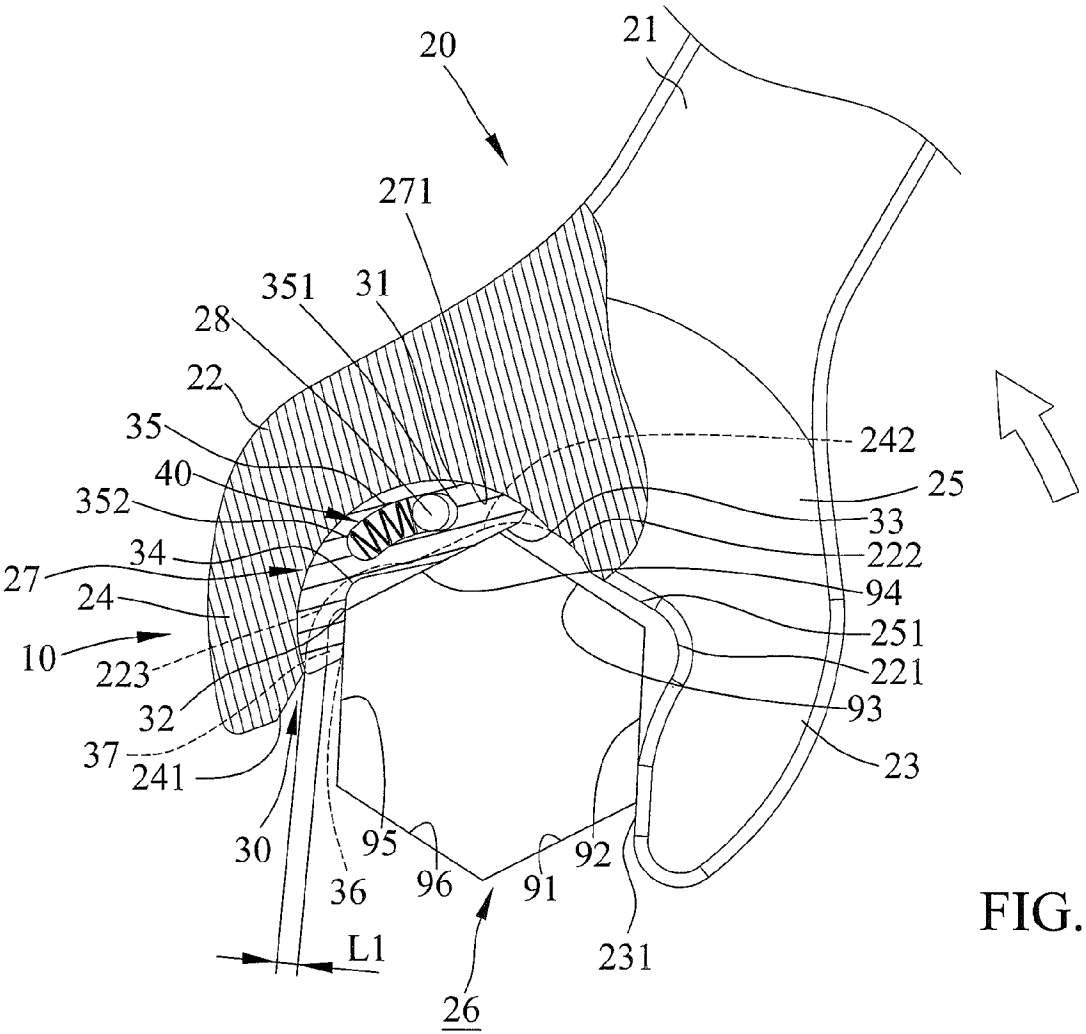
FIG. 12 shows a view similar to FIG. 11, illustrating further rotation of the open end wrench of FIG. 11 in the non-driving direction.

With reference to FIG. 12, when rotation of open end wrench 10 in the reverse direction is finished, slide 30 can be smoothly and rapidly moved to the extended position, because the two ends of elastic device 40 respectively presses against guide 28 and pressing end 352 of guiding slot 35. When force-applying face 231 of first jaw 23 abuts second force-receiving face in the first rotating direction 92A of workpiece 90, elastic device 40 returns slide 30 to the extended position and makes first wrenching face 32 of slide 30 abut fifth force-receiving face in the first rotating direction 95A of workpiece 90. Furthermore, first wrenching face 32 of slide 30 automatically comes in surface contact with fifth force-receiving face in the first rotating direction 95A of workpiece 90 such that first wrenching face 32 of slide 30 is substantially parallel to force-applying face 231 of first jaw 23, reliably positioning jaw portion 22 in the new driving position ready for driving workpiece 90 in the clockwise direction without the need of disengaging workpiece 90 from wrenching space 26 of jaw portion 22 and subsequent reengaging workpiece 90 in wrenching space 26, allowing fast driving of workpiece 90.

Thus, open end wrench 10 is moved to the next driving position and is in a state similar to that shown in FIG. 8. The user can again rotate handle 21 in the clockwise direction to make jaw portion 22 rotate about axis C of workpiece 90 and, thus, drive workpiece 90 in the clockwise direction.

Spacings L between wings 37 and first and second support walls 272 and 273 vary during rotation of open end wrench 10 in the non-driving direction (see spacings L1, L2, and L3 in FIGS. 8-12). Spacings L avoid operational interference to sliding movement of slide 30 in sliding groove 27 while first and second jaws 23 and 24 and first wrenching face 32 and first and second wings 36 of slide 30 rotate about workpiece 90.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open end wrench capable of fast driving a workpiece, with the workpiece including first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the jaw portion further including an arcuate sliding groove facing the wrenching space, with the sliding groove including spaced, first and second support walls and an arcuate sliding wall extending between the first and second support walls, with a guide fixed in the sliding groove;

a slide slideably received in the sliding groove between an extended position and a retracted position, with the slide including a first side having an arcuate sliding face slideable along the sliding wall of the sliding groove, with the slide further including a second side opposite to the first side of the slide and located outside of the sliding groove, with the second side of the slide including a first wrenching face, with the first wrenching face adapted to correspond to the fourth force-receiving face in the first rotating direction of the workpiece when the slide is in the extended position, with the slide further including a top face and a bottom face, with the slide further including an arcuate guiding slot extending from the top face through the bottom face, with the guide received in the guiding slot, preventing the slide from disengaging from the sliding groove, with the guiding slot including a pressing end; and an elastic device having two ends respectively abutting the guide and the pressing end of the guiding slot for biasing the slide to the extended position, the first wrenching face of the slide including first and second wings respectively extending away from the top and bottom faces of the first wrenching face, with each of the first and second wings including an inner face and an outer face, with the first and second jaws and the first wrenching face and the inner faces of the first and second wings of the slide together define a curve of a circle having a center located on an axis of the workpiece, allowing the first and second jaws and the first wrenching face and the first and second wings of the slide to rotate about the workpiece and allowing the first wrenching face and the first and second wings to slide along a circumference of a circumscribed circle of the workpiece without interference, with a spacing formed between the outer face of each of the first and second wings and one of the first and second support walls, with the spacings avoiding operational interference to sliding movement of the slide in the sliding groove while the first and second jaws and the first wrenching face and the first and second wings of the slide rotate about the workpiece.

2. The open end wrench as claimed in claim 1, with the jaw portion including a throat intermediate the first and second jaws, with the throat and the first and second jaws together defining a wrenching space adapted for receiving the workpiece, with the first jaw including a force-applying face facing the wrenching space and facing a front end of the second jaw, with the force-applying face adapted to correspond to the first force-receiving face in the first rotating direction of the workpiece.

3. The open end wrench as claimed in claim 1, with the guide having two ends fixed to the first and second support walls.

4. The open end wrench as claimed in claim 1, with the guiding slot including an abutting end, with the abutting end being in contact with the guide when the slide is in the extended position.

5. The open end wrench as claimed in claim 1, with the slide further including a second wrenching face at an angle of 120° to the first wrenching face, with the second wrenching face adapted to correspond to the third force-receiving face in the first rotating direction of the workpiece.

6. The open end wrench as claimed in claim 5, with the slide further including an evasive portion between the first and second wrenching faces, with the evasive portion of the slide adapted to allow entrance of the third force-receiving face in the second rotating direction of the workpiece.

7. The open end wrench as claimed in claim 1, with the sliding face of the slide having a first curvature, with the sliding wall of the sliding groove having a second curvature equal to the first curvature, with the sliding face of the slide smoothly slideable along the sliding wall of the sliding groove, with the sliding face adapted to transmit reactive force from the workpiece to the sliding wall and to avoid concentration of stress on the slide, increasing torque bearing capacity of the slide when the workpiece is driven by the body to rotate.

8. The open end wrench as claimed in claim 7, with the guiding slot having a third curvature equal to the second curvature, allowing relative smooth, arcuate sliding between the guiding groove of the slide and the guide in the sliding groove without operational interference therebetween.

9. The open end wrench as claimed in claim 1, with the top face of the slide slideably abutting the first support wall of the sliding groove, with the bottom face of the slide slideably abutting the second support wall of the sliding groove, with the top and bottom faces symmetrically supported by the first and second support walls.

10. The open end wrench as claimed in claim 1, with the first and second jaws and the jaw portion integrally formed as a single and inseparable component of a same material.

11. The open end wrench as claimed in claim 1, with the throat including a push face facing the wrenching space, with the push face at an angle of 120° to the force-applying face of the first jaw, with the push face of the throat adapted to correspond to the second force-receiving face in the first rotating direction of the workpiece.

12. The open end wrench as claimed in claim 11, with the second jaw including first and second faces, with the first face of the second jaw facing the wrenching space and the throat, with the second face of the second jaw facing the wrenching space and a front end of the first jaw, with the first face of the second jaw at an angle of 120° to the second face of the second jaw, with the first and second faces adapted to correspond respectively to the fourth and third force-receiving faces in the first rotating direction of the workpiece, with the first face of the second jaw parallel to the force-applying face of the first jaw, with a first evasive portion formed between the force-applying face of the first jaw and the push face of the throat, with the first evasive portion adapted to allow entrance of the first force-receiving face in the second rotating direction of the workpiece, with a second evasive portion formed between the push face of the throat and the second face of the second jaw, with the first evasive portion adapted to allow entrance of the second force-receiving face in the second rotating direction of the workpiece, with the jaw portion further including a third evasive portion between first and second faces of the second jaw, with third evasive portion adapted to allow entrance of the third force-receiving face in the second rotating direction of workpiece.

13. The open end wrench as claimed in claim 1, with the elastic device including an elastic element received in the guiding slot of the slide, with the first and second support walls of the sliding groove parallel to each other and having a spacing therebetween, with the top and bottom faces of the slide parallel to each other and having a height in a height direction of the slide equal to the spacing between the first and second support walls, with the guiding slot of the slide having a height in the height direction of the slide equal to the height of the slide, with the guiding slot having a width in a width direction perpendicular to the height direction of the guiding slot, with the width of the guiding slot equal to a diameter of the guide, with the height of the guiding slot larger than 1.5 times the width of the guiding slot, with the elastic element received in the guiding slot having a height in the height direction of the slide not larger than the height of the guiding slot, with the height of the elastic element larger than the width of the guiding slot and larger than 0.5 times the height of the guiding slot.

14. An open end wrench capable of fast driving a workpiece, with the workpiece including an outer periphery having first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the first and second jaws and the jaw portion integrally formed as a single and inseparable component of a same material, with the jaw portion further including a throat intermediate the first and second jaws, with the first jaw including a front end and a rear end, with the rear end of the first jaw connected to the throat, with the second jaw including a front end and a rear end, with the rear end of the second jaw connected to the throat, with the throat and the first and second jaws together defining a wrenching space, with the wrenching space adapted to receive the workpiece, with the first jaw including a force-applying face facing the wrenching space, with the jaw portion further including an arcuate sliding groove facing the wrenching space, with the sliding groove including spaced, first and second support walls and an arcuate sliding wall extending between the first and second support walls, with a guide fixed in the sliding groove, with the guide including two ends fixed in the first and second support walls;

a slide slideably received in the sliding groove, with the slide including a first side having an arcuate sliding face slideable along the sliding wall of the sliding groove, with the slide capable of driving the workpiece or sliding along the outer periphery of the workpiece, with the slide movable between an extended position and a retracted position, with the slide further including a second side opposite to the first side of the slide, with the second side of the slide located outside of the sliding groove and including a first wrenching face located on a front end of the slide, with the slide further including a top face and a bottom face, with the top face slideably abutting the first support wall, with the bottom face slideably abutting the second support wall, with the top and bottom faces symmetrically supported by the first and second support walls, with the slide further including an arcuate guiding slot extending from the top face through the bottom face, with the guide received in the guiding slot, preventing the slide from disengaging from the sliding groove, with the guiding slot including an abutting end and a pressing end, with the front end of the slide including first and second wings respectively extending away from the top and bottom faces, with each of the first and second wings including inner and outer faces, with the inner faces of the first and second wings adapted to drive the workpiece; and an elastic device mounted in the guiding slot and having two ends respectively abutting the guide and the pressing end of the guiding slot, with the elastic device urging the abutting end of the guiding slot to contact with the guide, biasing the slide to the extended position, with the inner faces of the first and second wings adapted to contact with the outer periphery of the workpiece received in the wrenching space to increase a contact area between the workpiece and the slide, with the outer faces of the first and second wings spaced from the body to avoid friction between the body and the first and second wings, allowing smooth sliding movement of the slide between the extended position and the retracted position.

15. The open end wrench as claimed in claim 14, with the first wrenching face including a top extension face extending away from the top face and a bottom extension face extending away from the bottom face, with the top and bottom extension faces coplanar to the first wrenching face and located on the inner faces of the two wings.

16. The open end wrench as claimed in claim 15, with the first and second jaws and the first wrenching face and the top and bottom extension faces of the slide together defining a curve of a circle having a center located on an axis of the workpiece, with the first and second jaws and the first wrenching face and the top and bottom extension faces of the slide rotatable along about the center of the workpiece, with the first wrenching face and the top and bottom extension faces slideable along a circumference of a circumscribed circle of the workpiece without interference.

17. The open end wrench as claimed in claim 14, with the sliding wall of the sliding groove free of holes, grooves, and recesses and having a concave, arcuate face, with the sliding face of the slide free of holes, grooves, and recesses and having a convex, arcuate face, and with the guiding slot free of holes, grooves, and recesses.

18. The open end wrench as claimed in claim 14, with the force-applying face facing the front end of the second jaw, with the sliding groove formed in the second jaw and the throat and facing the wrenching space, with the force-applying face adapted to correspond to the first force-receiving face in the first rotating direction of the workpiece, with the first wrenching face and the two wings of the slide adapted to correspond to the fourth force-receiving face in the first rotating direction of the workpiece when the slide is in the extended position.

19. The open end wrench as claimed in claim 14, with the sliding face of the slide having a first curvature, with the sliding wall of the sliding groove having a second curvature equal to the first curvature, with the sliding face of the slide smoothly slideable along the sliding wall of the sliding groove, with the sliding face adapted to transmit reactive force from the workpiece to the sliding wall and to avoid concentration of stress on the slide, increasing torque bearing capacity of the slide when the workpiece is driven by the body to rotate, with the guiding slot having a third curvature equal to the second curvature, allowing relative smooth, arcuate sliding between the guiding groove of the slide and the guide in the sliding groove without operational interference therebetween.

20. The open end wrench as claimed in claim 14, with the slide further including a second wrenching face at an angle of 120° to and located behind the first wrenching face, with the second wrenching face adapted to correspond to the third force-receiving face in the first rotating direction of the workpiece, with the slide further including an evasive portion between the first and second wrenching faces, with the evasive portion of the slide adapted to allow entrance of the third force-receiving face in the second rotating direction of the workpiece.

21. The open end wrench as claimed in claim 20, with the throat including a push face facing the wrenching space, with the push face at an angle of 120° to the force-applying face of the first jaw, with the push face of the throat adapted to correspond to the second force-receiving face in the first rotating direction of the workpiece.

22. The open end wrench as claimed in claim 21, with the second jaw including first and second faces, with the first face of the second jaw facing the wrenching space and the rear end of the first jaw, with the second face of the second jaw facing the wrenching space and the front end of the first jaw, with the first face of the second jaw at an angle of 120° to the second face of the second jaw, with the first and second faces of the second jaw adapted to correspond respectively to the fourth and third force-receiving faces in the first rotating direction of the workpiece, with the first face of the second jaw parallel to the force-applying face of the first jaw, with a first evasive portion formed between the force-applying face of the first jaw and the push face of the throat, with the first evasive portion adapted to allow entrance of the first force-receiving face in the second rotating direction of the workpiece, with a second evasive portion formed between the push face of the throat and the second face of the second jaw, with the second evasive portion adapted to allow entrance of the second force-receiving face in the second rotating direction of the workpiece, with the jaw portion further including a third evasive portion between first and second faces of the second jaw, with third evasive portion adapted to allow entrance of the third force-receiving face in the second rotating direction of workpiece.

23. The open end wrench as claimed in claim 14, with the elastic device including an elastic element received in the guiding slot, with the first and second support walls of the sliding groove parallel to each other and having a spacing therebetween, with the top and bottom faces of the slide parallel to each other and having a height in a height direction of the slide equal to the spacing between the first and second support walls, with the guiding slot of the slide having a height in the height direction of the slide equal to the height of the slide, with the guiding slot having a width in a width direction perpendicular to the height direction of the guiding slot, with the width of the guiding slot equal to a diameter of the guide, with the height of the guiding slot larger than 1.5 times the width of the guiding slot, with the elastic element having a height in the height direction of the slide not larger than the height of the guiding slot, with the height of the elastic element larger than the width of the guiding slot and larger than 0.5 times the height of the guiding slot.

24. The open end wrench as claimed in claim 23, with the elastic element being one of a resilient plate, a compression spring, a torsion spring, and a dual compression spring, with the dual compression spring having spaced upper and lower coil portions and a connecting portion between the upper and lower coil portions, with the upper and lower coil portions spaced in the height direction of slide.

25. The open end wrench as claimed in claim 14, with the elastic device including a base and two compression springs, with the base including two protrusions spaced in a height direction of the slide or two receptacles spaced in the height direction of the slide, with each of the two compression springs having an end mounted to one of the two protrusions or one of the two receptacles, with the two compression springs spaced in the height direction of the slide.

* * * * *